US007369139B2

(12) United States Patent
Hancock et al.

(10) Patent No.: US 7,369,139 B2
(45) Date of Patent: May 6, 2008

(54) BACKGROUND RENDERING OF IMAGES

(75) Inventors: William R. Hancock, Phoenix, AZ (US); Robert J. Quirk, Peoria, AZ (US); Panagiotis Papadatos, Scottsdale, AZ (US)

(73) Assignee: Honeywell International, Inc., Morristown, NJ (US)

( * ) Notice: Subject to any disclaimer, the term of this patent is extended or adjusted under 35 U.S.C. 154(b) by 31 days.

(21) Appl. No.: 10/717,726

(22) Filed: Nov. 20, 2003

(65) Prior Publication Data

US 2005/0110804 A1 May 26, 2005

(51) Int. Cl.

| | |
|---|---|
| ***G09G 5/02*** | (2006.01) |
| ***G09G 5/00*** | (2006.01) |
| ***G09G 5/399*** | (2006.01) |
| ***G06T 15/40*** | (2006.01) |

(52) U.S. Cl. ..... 345/592; 345/422; 345/629; 345/539

(58) Field of Classification Search ..... 345/592
See application file for complete search history.

(56) References Cited

U.S. PATENT DOCUMENTS 5,757,364 A * 5/1998 Ozawa et al. ..... 345/539
6,771,274 B2 * 8/2004 Dawson ..... 345/592

* cited by examiner

*Primary Examiner*—Kee M. Tung
*Assistant Examiner*—Aaron M Richer
(74) *Attorney, Agent, or Firm*—Ingrassia Fisher & Lorenz

(57) ABSTRACT

An apparatus includes a rendering engine to render a foreground of an image. The apparatus also includes a logic, separate from the rendering engine, to merge at least one background color with the foreground of the image.

18 Claims, 5 Drawing Sheets

114

| WINDOW ID | A BUFFER BACKGROUND COLOR | B BUFFER BACKGROUND COLOR |
|---|---|---|
| 0 | COLOR A | COLOR B |
| 1 | COLOR A | COLOR B |
| • • • | | |
| 15 | COLOR A | COLOR B |

FIG. 2

BACKGROUND RENDERING OF IMAGES

BACKGROUND RENDERING OF IMAGES

1. Technical Field

The application relates generally to image processing, and, more particularly, to background rendering of images.

2. Background

Image processing can be a computational expensive task that may consume limited hardware resources. Typically, image processing includes the rendering of both a foreground and background of an image. Conventional image processing uses a rendering engine that executes a software application to generate pixel data for the foreground and the background of the images, thereby creating images for display. The foreground of an image is usually a more complex creation in comparison to the background. For example, the background may be as simple as a solid color. However, background rendering can consume limited processing bandwidth of the rendering engine. Such bandwidth could be better used for rendering the more complex foreground parts of the image.

A typical implementation of a rendering engine uses a back to front rendering, where the background color of a window is processed first using a very fast two dimensional (2D) clear engine. However, a rendering engine based on a front to back rendering implementation generally achieves better anti-aliasing results. With this latter implementation, the background is processed with the slower, normal three dimensional (3D) rendering path used for processing the foreground.

SUMMARY

Methods, apparatus and systems for background rendering of an image are described. Embodiments of the invention allow for a front to back rendering order for the generating of an image that allows for better anti-aliasing results (relative to back to front rendering). As described in more detail below, embodiments of the invention allow for a front to back rendering without the large time penalties normally associated with the generation of the background color fill. In an embodiment, the background fill information is generated by a hardware logic (such as a field programmable gate array) that is separate from the software being executed within a rendering engine. Accordingly, embodiments of the invention free up the bandwidth of the rendering engine, thereby allowing for the rendering of more complex foreground image (without the time penalties associated therewith). Moreover, this separate hardware logic merges the background fill data with the foreground data to form the final image. In an embodiment, this separate hardware logic allows for the merging of a background video and/or a background color with the foreground image rendered by the rendering engine.

In one embodiment, an apparatus includes a rendering engine to render a foreground of an image. The apparatus also includes a logic, separate from the rendering engine, to merge at least one background color with the foreground of the image.

BRIEF DESCRIPTION OF THE DRAWINGS

Embodiments of the invention may be best understood by referring to the following description and accompanying drawings which illustrate such embodiments. The numbering scheme for the Figures included herein are such that the leading number for a given reference number in a Figure is associated with the number of the Figure. For example, an apparatus 100 can be located in FIG. 1. However, reference numbers are the same for those elements that are the same across different Figures. In the drawings:

FIG. 2 illustrates a background color table used for merging a background color with a rendered foreground image, according to one embodiment of the invention.

DETAILED DESCRIPTION

Figure 1:
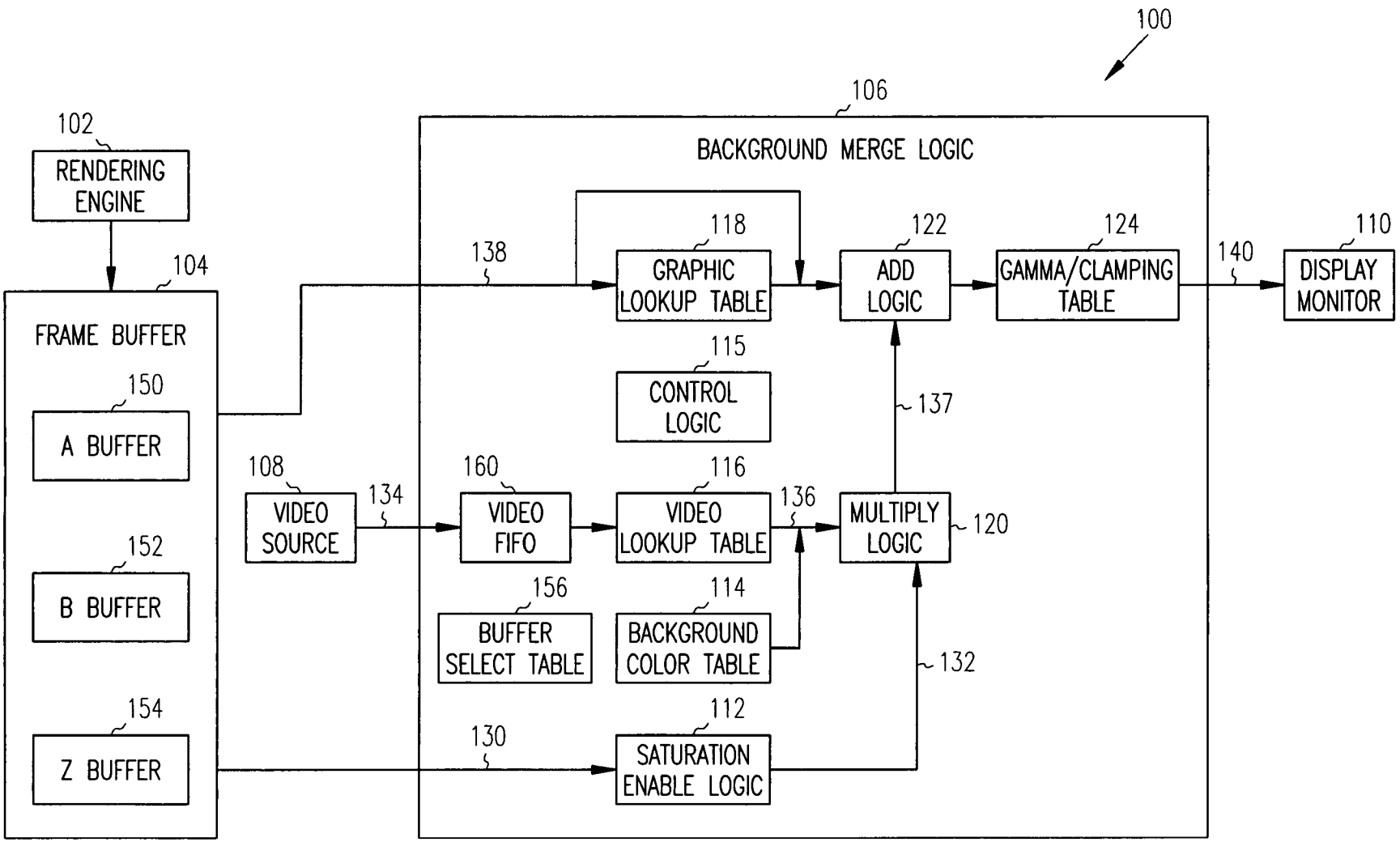
FIG. 1 illustrates an apparatus that provides for the merging of background colors with a rendered foreground image, according to one embodiment of the invention.

Methods, apparatuses and systems for background rendering of images are described. In the following description, numerous specific details such as logic implementations, opcodes, means to specify operands, resource partitioning/sharing/duplication implementations, types and interrelationships of system components, and logic partitioning/integration choices are set forth in order to provide a more thorough understanding of the present invention. It will be appreciated, however, by one skilled in the art that embodiments of the invention may be practiced without such specific details. In other instances, control structures, gate level circuits and full software instruction sequences have not been shown in detail in order not to obscure the embodiments of the invention. Those of ordinary skill in the art, with the included descriptions will be able to implement appropriate functionality without undue experimentation.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Embodiments of the invention include features, methods or processes embodied within machine-executable instructions provided by a machine-readable medium. A machine-readable medium includes any mechanism which provides (i.e., stores and/or transmits) information in a form accessible by a machine (e.g., a computer, a network device, a personal digital assistant, manufacturing tool, any device with a set of one or more processors, etc.). In an exemplary embodiment, a machine-readable medium includes volatile and/or non-volatile media (e.g., read only memory (ROM), random access memory (RAM), magnetic disk storage media, optical storage media, flash memory devices, etc.), as well as electrical, optical, acoustical or other form of propagated signals (e.g., carrier waves, infrared signals, digital signals, etc.)).

Such instructions are utilized to cause a general or special purpose processor, programmed with the instructions, to perform methods or processes of the embodiments of the invention. Alternatively, the features or operations of embodiments of the invention are performed by specific hardware components which contain hard-wired logic for performing the operations, or by any combination of programmed data processing components and specific hardware components. Embodiments of the invention include software, data processing hardware, data processing system-implemented methods, and various processing operations, further described herein.

A number of figures show block diagrams of systems and apparatus for background rendering of images, in accordance with embodiments of the invention. A number of figures show flow diagrams illustrating operations for background rendering of images. The operations of the flow diagrams will be described with references to the systems/apparatus shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

FIG. 1 illustrates an apparatus that provides for the merging of background colors with a rendered foreground image, according to one embodiment of the invention. FIG. 1 illustrates an apparatus 100 that includes a rendering engine 102, a frame buffer 104, a background merge logic 106, a video source 108 and a display monitor 110. The frame buffer 104 includes an A buffer 150, a B buffer 152 and a Z buffer 154. The background merge logic 106 includes a saturation enable logic 112, a background color table 114, a control logic 115, a video lookup table 116, a graphic lookup table 118, a multiply logic 120, an add logic 122, gamma/clamping tables 124, a video FIFO 160 and a buffer select table 156. Although not shown for sake of clarity, the control logic 115 is coupled to the saturation enable logic 112, the background color table 114, the video lookup table 116, the graphic lookup table 118, the multiply logic 120, the add logic 122, the gamma/clamping tables 124, the video FIFO 160 and the buffer select table 156.

The rendering engine 102 generates a rendered image (that includes the color values for the foreground pixels that comprise the rendered image). The rendering engine 102 stores colors values (red, green, blue, alpha, window identification) for the foreground pixels in the A buffer 150, the B buffer 152 and the Z buffer 154. The A buffer 150 and the B buffer 152 are ping-pong type buffers. In particular, the rendering engine 102 is writing to one of these buffers (current write buffer), while the other buffer is being read from for display (current read buffer). For each pixel, the A buffer 150 and the B buffer 152 include alpha, red, green and blue (ARGB) intensity values. The alpha intensity value specifies the amount of an independent pixel source to be merged with the image rendered by the rendering image 102 included in the red, green and blue pixel values.

In one embodiment, an image may be made of a number of independently rendered smaller regions (windows). Each window represents a part of the overall displayed image. The Z buffer 154 includes a number of entries, wherein a given entry includes an identification of a window for a given pixel in an image. For example, in an embodiment, an image may include 16 different windows. As further described below, the lookup into the Z buffer 154 provides an identification of a window within which a given pixel is located. A lookup into the buffer select table 156 based on this window identification is performed to select either the A buffer 150 or the B buffer 152 for display (also referred to as front buffer detection). Therefore, a given pixel in a display is retrieved from either the A buffer 150 or the B buffer 152. Accordingly, in an embodiment wherein an image is partitioned into 16 windows, the buffer select table 156 is a 16-location, 1-bit wide look-up table. In one such embodiment, the buffer select table 156 includes 16 different entries that include a single bit to identify the A buffer 150 or the B buffer 152. In one embodiment, the values stored in the buffer select table 156 are updated at the completion of a given scene being processed by the background merge logic 106.

The saturation enable logic 112 is coupled to receive alpha intensity values 130 from the current read buffer for the pixels to be displayed. The saturation enable logic 112 is coupled to output background attenuation 132, which is inputted into the multiply logic 120. In one embodiment, the saturation enable logic 112 either inverts the alpha intensity values 130 (1−alpha) or passes the alpha intensity values 130 for special blending modes. In an embodiment, the attenuation value 132 represents a value in a range of zero to one.

The video source 108 is coupled to input video 134 into a video FIFO 160. In an embodiment, the video FIFO 160 is partitioned into two banks. After writing a frame of the video 134 into a first bank of the video FIFO 160, the control logic 115 causes the next frame of the video 134 to be written to the second bank, then writing to the first bank, etc.

The video FIFO 160 is coupled to the video lookup table 116. In one embodiment, the background color table 114 includes a number of entries for storage of background color data for each active window. In an embodiment, the background color table 114 includes 16 entries. A given entry therein is associated with a window in the image. An entry includes an identification of a window and the color values for the window. One embodiment of the background color table 114 is illustrated in FIG. 2, which is described in more detail below.

In one embodiment, the video lookup table 116 or the background color table 114 are coupled to input a background color 136 into the multiply logic 120. In an embodiment, the video lookup table 116 and the background color table 114 are coupled to input a background color 136 into the multiply logic 120. In one such embodiment, an application executing external to the background merge logic 106 configures video position registers internal to the control logic 115 (not shown). For example, in the system 500 of FIG. 5, the processor therein may execute a graphics application that causes the generation of instructions that are stored in the background merge logic 106 to allow for various control and configuration of the background merge logic 106 (including the setting of these video position registers). The configuration of these video position registers define where video is selected for display. Accordingly, in an embodiment, the control logic 115 enables the display of background color (from the background color table 114) at locations on the display where video (from the video source 108) is not selected for display.

The control logic 115 causes a background color 136 to be input into the multiply logic 120 from the video lookup table 116 and/or the background color table 114. The control logic 115 includes a number of control registers for controlling the merging of the video 134 or the color values of the background pixels from the background color table 114 with the foreground image separately rendered by the rendering engine 102. The multiply logic 120 outputs an adjusted background color 137 based on the background color 136 and the background attenuation 132. The adjusted background color 137 is inputted into the add logic 122.

The color values of the rendered image 138 are inputted from the current read buffer into the graphic lookup table 118 and the add logic 122. As further described below, in one embodiment, the control logic 115 performs smooth shading for these color values based on a lookup into the graphic lookup table 118. As shown, a lookup is performed into the graphic lookup table 118 to output a value that has been smooth shaded based on the color values retrieved from the current read buffer. Moreover, as shown, this lookup may be bypassed, thereby allowing for direct input of the color values for the foreground pixel into the add logic 122. The add logic 122 is coupled to output the final image 140 to the gamma/clamping tables 124. The gamma/clamping tables 124 are coupled to output a resulting image 140 to the display monitor 110.

As further described below, in one embodiment, the background merge logic 106 merges a background color with the rendered foreground color based on a pre-multiply of the background color with the alpha intensity value for the foreground pixel to allow for an alpha source saturate blending. The adjusted background color is added to the color data (red, green and blue, respectively) for the selected foreground pixel as illustrated by equations (1)-(3) (which includes an alpha source saturation blending):

$$R_{RESULT}=R_{BACKGROUND}*(1-\mathrm{ALPHA}_{SRC})+R_{SRC} \quad (1)$$

$$G_{RESULT}=G_{BACKGROUND}*(1-\mathrm{ALPHA}_{SRC})+G_{SRC} \quad (2)$$

$$B_{RESULT}=B_{BACKGROUND}*(1-\mathrm{ALPHA}_{SRC})+B_{SRC} \quad (3)$$

While FIG. 1 illustrates the merging of a video or a background color with the rendered foreground image, embodiments of the invention are not so limited. In another embodiment, video is not merged with the rendered foreground image. Therefore, the apparatus 100 does not include the video source 108 coupled to input the video 134 into the video FIFO 160 and does not include the video lookup table 116. Accordingly, the background merge logic 106 merges different types of background colors (and not video). The operations of the apparatus 100 are described in more detail below in conjunction with the flow diagrams 300 and 400 of FIGS. 3 and 4, respectively.

FIG. 2 illustrates a background color table used for merging a background color with a rendered foreground image, according to one embodiment of the invention. In particular, FIG. 2 illustrates one embodiment of the background color table 114. As shown, the background color table 114 maintains background color values for the different possible windows that may be displayed. Accordingly, the background colors in the background color table 114 are managed in a double buffered scheme similar to that of the A buffer 150 and the B buffer 152. Therefore, for a given entry, there are two color values: background color A and background color B associated with each window in the image to be displayed. The background color A merges with the corresponding pixel from the A buffer 150. The background color B merges with the corresponding pixel from the B buffer 152.

In one embodiment, one of the window identifications is reserved for pixels not actively populated. Therefore, if merge is to occur for a region of an image that is not associated with a window identification therein, this reserve window identification is used. In one embodiment, the color value for this reserved window identification is black. In an embodiment, logic (applications/hardware, etc.) external to the background merge logic 106 cannot modify the entry for this reserved window identification in the background color table 114. In one embodiment, logic (applications/hardware, etc.) external to the background merge logic 106 updates the colors stored in the background color table 114.

In one embodiment, for each window of a frame of the image, logic (applications/hardware, etc.) external to the background merge logic 106 stores the background color in the corresponding A-background entry for this window in the background color table 114, while the background color in the corresponding B-background entry for this window is being displayed and vice versa. Accordingly, this allows the updating of the next frame's background color for the different windows without interfering with the display of the current frame.

Moreover, as described in more detail below, the window identification stored in the Z buffer 154 and the A/B buffer selection stored in the buffer select table 156 are used to address the background color table 114 in a table lookup approach. In other words, the Z buffer 154 and the buffer select table 156 are used to select the location of the color values of the background color to be merged with the different parts of the rendered foreground image for display. One embodiment of logic (applications/hardware, etc.) to load the color values into the background color table 114 is described in more detail below in conjunction with the system 500 of FIG. 5.

Figure 3:
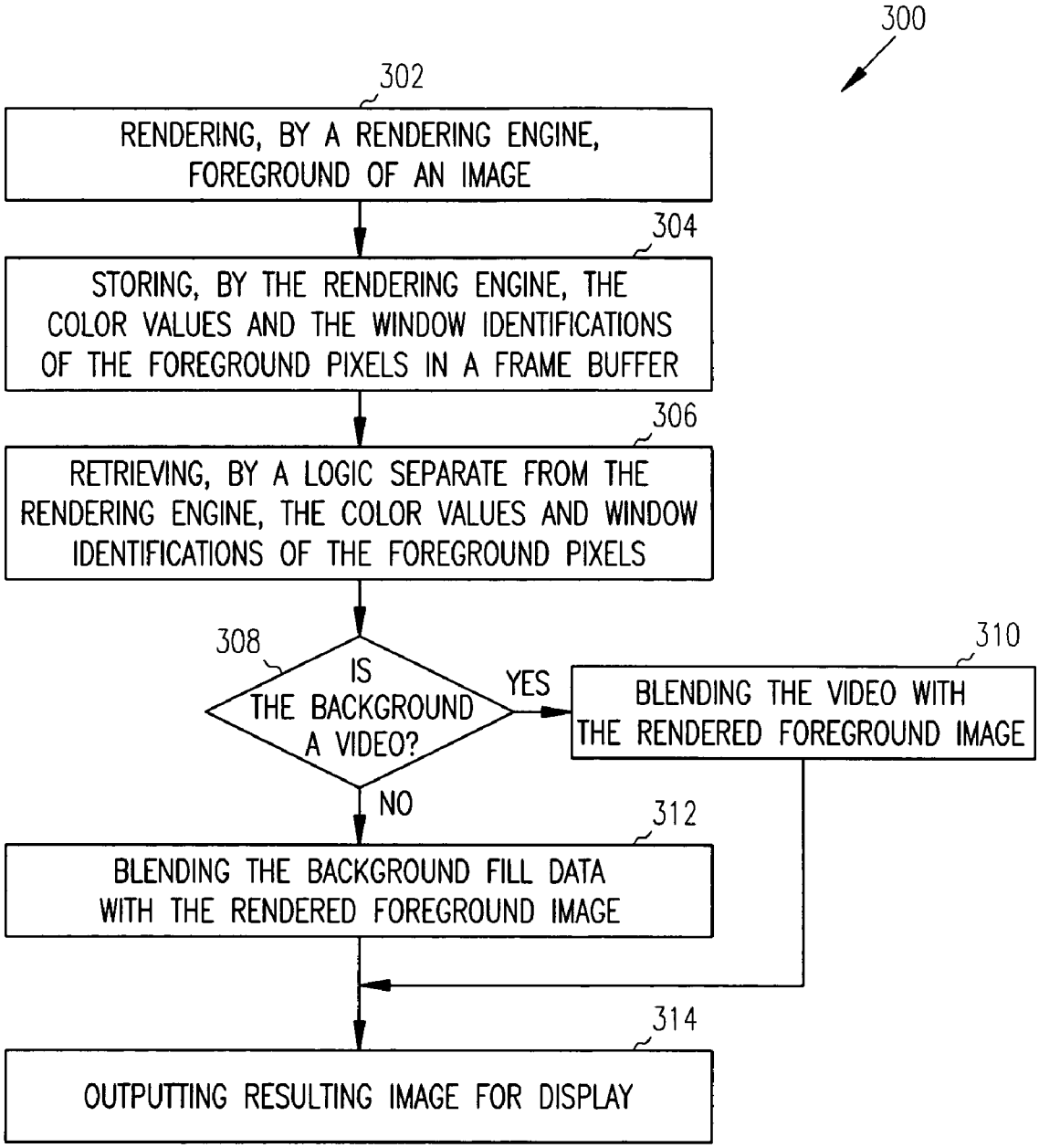
FIG. 3 illustrates a flow diagram for rendering an image, according to one embodiment of the invention.

One embodiment of the operations of the apparatus 100 is now described. In particular, FIG. 3 illustrates a flow diagram for rendering an image, according to one embodiment of the invention.

In block 302 of the flow diagram 300, the foreground of an image is rendered by a rendering engine. With reference to the embodiment of FIG. 1, the rendering engine 102 renders the foreground of an image. In an embodiment, the foreground may be different types of symbology. For example, the foreground may be text, a cursor, etc. In an embodiment, the rendering engine 102 generates the color values (e.g., red, green, blue, and alpha) for the different pixels in the foreground. Additionally, in an embodiment, the rendering engine 102 generates an identification of a window on the display screen wherein the pixel is to be displayed. In particular, the display screen is partitioned into a number of windows for processing of the pixels. Accordingly, the rendering engine 102 generates the identification of one of such windows within which the pixel is located.

Figure 5:
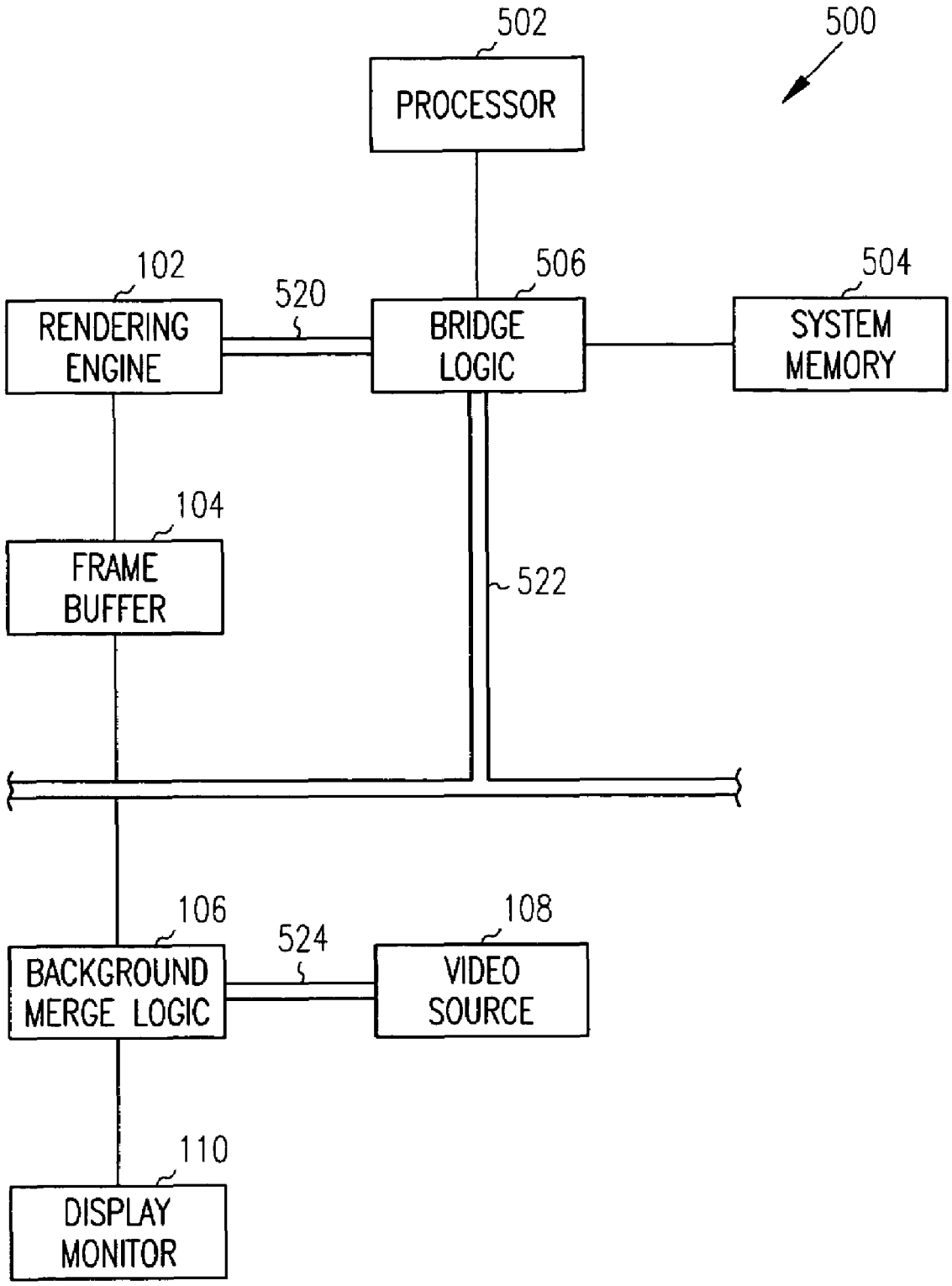
FIG. 5 illustrates a system that merges a background color with a rendered foreground image, according to one embodiment of the invention.

One embodiment of a system that includes the apparatus 100 is described in more detail below in conjunction with FIG. 5. As described, a processor in the system generates and stores a number of instructions into a system memory. Such instructions control the rendering of the image by the rendering engine 102. Therefore, the rendering engine 102 retrieves these instructions from the system memory. Based on such instructions, the rendering engine 102 renders the foreground of the image. In one embodiment, software executing on a processor internal to the rendering engine 102 executes these instructions for rendering the foreground of the image. Control continues at block 304.

In block 304, the color values and the window identifications of the foreground pixels are stored in a frame buffer, by the rendering engine. With reference to the embodiment of FIG. 1, the rendering engine 102 stores the color values and the window identifications for the different foreground pixels in the frame buffer 104. As described above, the A buffer 150 and the B buffer 152 (in the frame buffer 104) are ping-pong type buffers. The rendering engine 102 stores the color values of the foreground to the current write buffer (either the A buffer 150 or the B buffer 152). In one embodiment, each foreground pixel has an associated entry in the current write buffer. Such an entry includes an alpha intensity value, a red value, a green value and a blue value. The rendering engine 102 also stores the window identification of the foreground pixel into the Z buffer 154. Control continues at block 306.

In block 306, the color values and the window identifications of the foreground pixels are retrieved, by logic that is separate from the rendering engine. With reference to the embodiment of FIG. 1, the background merge logic 106 retrieves the color value and the window identifications of the foreground pixels from the current read buffer (either the A buffer 150 or the B buffer 152) and from the Z buffer 154, respectively. As shown, the control logic 115 retrieves the color values of the rendered image 138, which are input into the graphic lookup table 118 and the add logic 122. The control logic 115 also retrieves the alpha intensity values 130 of the color values, which are input into the saturation enable logic 112. Control continues at block 308.

In block 308, a determination is made of whether the background is video. With reference to the embodiment of FIG. 1, the control logic 115 determines whether the background is video based on a Boolean value (stored in one of the control registers internal to the control logic 115) that includes whether to merge video with the rendered foreground image. This Boolean value may be configured by an application executing external to the background merge logic 106. For example, in the system 500 of FIG. 5, the processor therein may execute a graphics application that causes the generation of instructions that are stored in the system memory. Such instructions may be retrieved by the background merge logic 106 to allow for various control and configuration of the background merge logic 106 (including the setting of this Boolean value).

In block 310, upon determining that the background is video, the video is blended with the rendered foreground image. With reference to the embodiment of FIG. 1, the background merge logic 106 blends the video with the rendered foreground image. Control continues at block 314, which is described in more detail below.

In block 312, upon determining that the background is not video, the background fill data is blended with the rendered foreground image. With reference to the embodiment of FIG. 1, the background merge logic 106 blends the background color values with the rendered foreground image. A more detailed description of the operations for blending the background color values with the rendered foreground image is described in more detail below in conjunction with the flow diagram 400 of FIG. 4. Control continues at block 314.

In block 314, the resulting image is output for display. With reference to the embodiment of FIG. 1, the background merge logic 106 outputs the resulting image 140 for display to the display monitor 110. The operations of the flow diagram 300 may continue at block 302, as a different rendered foreground image is merged with the background video and/or the background colors.

Figure 4:
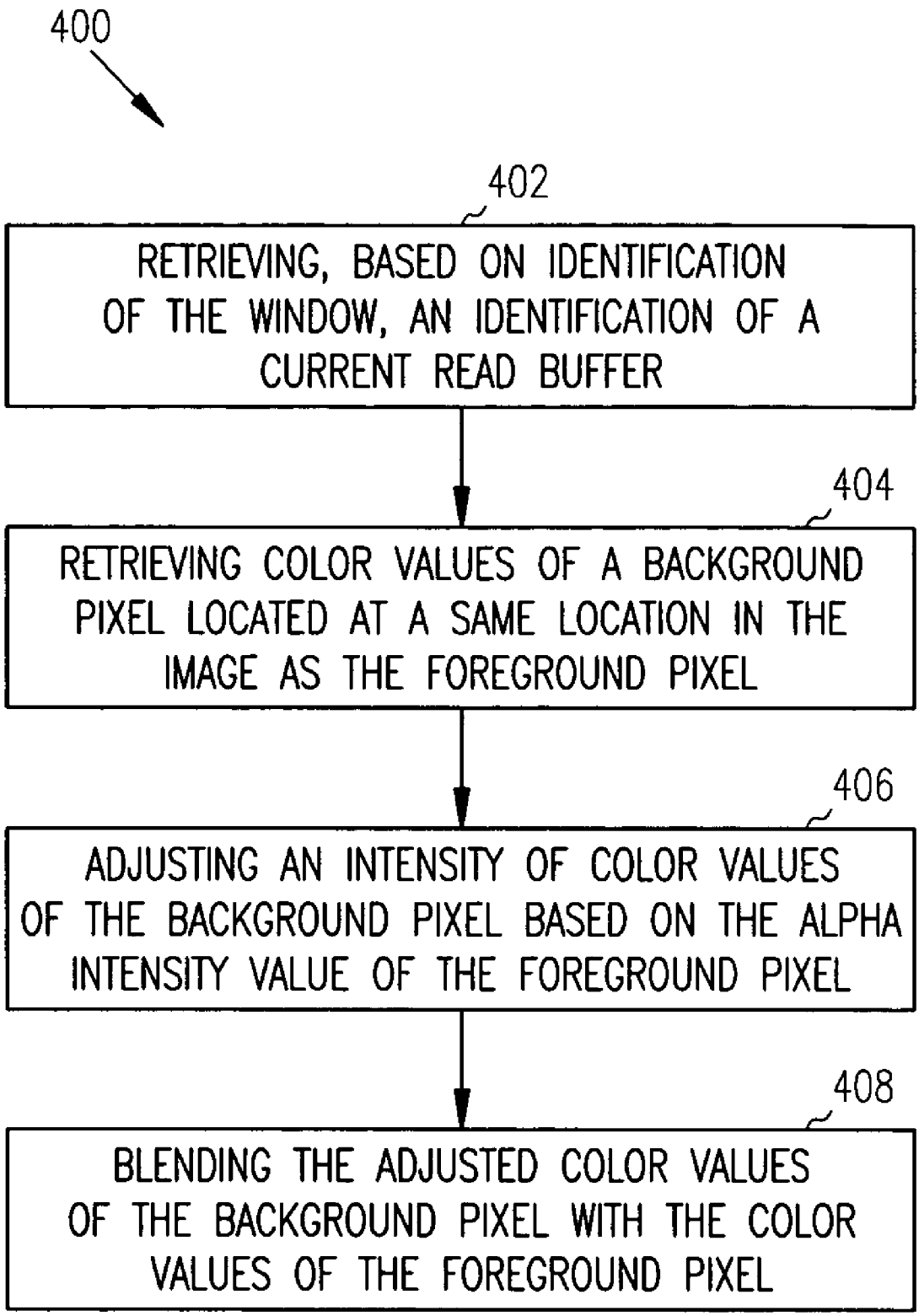
FIG. 4 illustrates a flow diagram for blending the background fill color with the rendered foreground image, according to one embodiment of the invention.

The operations for blending the background fill color with the rendered foreground image are now described. In particular, FIG. 4 illustrates a flow diagram for blending the background fill color with the rendered foreground image, according to one embodiment of the invention. For sake of clarity, the flow diagram 400 of FIG. 4 illustrates this blending operation for a single pixel in the image to be output for display. Accordingly, the operations of the flow diagram 400 may be performed for the different pixels in a given image to be output for display.

In block 402, based on an identification of the window that includes the foreground pixel to be processed, an identification of a current read buffer is retrieved. With reference to the embodiment of FIG. 1, the control logic 115 retrieves an identification of the current read buffer (either the A buffer 150 or the B buffer 152) based on the identification of the window for a pixel. In particular, the control logic 115 retrieves the identification of the window for a pixel from the Z buffer 154. Moreover, the control logic 115 performs a lookup into the buffer select table 156 that identifies either the A buffer 150 or the B buffer 152 as the current read buffer for the pixel. Control continues at block 404.

In block 404, color values of the background pixel located at the same location in the image as the foreground pixel (being processed) are retrieved. With reference to the embodiment of FIG. 1, the control logic 115 retrieves the color values of the background pixel from the background color table 114 or the video lookup table 116 based on the window identification and the current buffer selection (the A buffer 150 or the B buffer 152). The control logic 115 causes the background color 136 to be input into the multiply logic 120 from the background color table 114 or the video lookup table 116. Returning to FIG. 2 to illustrate the retrieval from the background color table 114, the control logic 115 selects the entry therein based on the identification of the window and the identification of the current read buffer (either the A buffer 150 or the B buffer 152). Control continues at block 406.

In block 406, an intensity of the color values of the background pixel is adjusted based on the alpha intensity value of the foreground pixel. With reference to the embodiment of FIG. 1, the control logic 115 retrieves the alpha intensity value (associated with the foreground pixel from the current read buffer), which is input into the saturation enable logic 112. The saturation enable logic 112 outputs the background attenuation 132 based on the alpha intensity value. In an embodiment, there are two blending modes: alpha source saturate and alpha blending (source alpha or 1−source alpha). Accordingly, if the background merge logic 106 is configured to be in the alpha source saturate blending mode, the saturation enable logic 112 outputs the background attenuation 132 that provides alpha source saturate blending. If the background merge logic 106 is configured to not be in the alpha source saturate blending mode, the saturation enable logic 112 outputs the background attenuation 132 with alpha blending. Accordingly, the two different modes (alpha source saturate and alpha blending) allow for the use of "alpha" or "1−alpha", respectively, for the blending operations.

The background attenuation 132 is inputted into the multiply logic 120. The multiply logic 120 adjusts the background color 136 based on the value of the background attenuation 132. As illustrated by equations (1)-(3) (set forth above for alpha source saturate blending), the background attenuation 132 has a value of '$1-ALPHA_{SRC}$'. The multiply logic 120 multiplies the background attenuation 132 by the background color 136 (for each of the red, green and blue background colors). Control continues at block 408.

In block 408, the adjusted color values of the background pixel are blended with the color values of the foreground pixel. With reference to the embodiment of FIG. 1, the control logic 115 retrieves the color values of the foreground pixel from the current read buffer (shown as the color values of the rendered image 138). In one embodiment, the control logic 115 smoothes shading for these color values based on a lookup into the graphic lookup table 118. As shown, a lookup is performed into the graphic lookup table 118 to output a value that has been smooth shaded based on the color values retrieved from the current read buffer. Moreover, as shown, this lookup may be bypassed, thereby allowing for direct input of the color values for the foreground pixel into the add logic 122. The adjusted background color 137 (which is the result of the background color adjustment operation) is input into the add logic 122.

The add logic 122 blends the color values of the foreground pixel with the color values of the adjusted background color 137. As illustrated by equations (1)-(3) (set forth above), the add logic 122 adds the red, green and blue value of the foreground pixel to the red, green and blue value of the adjusted background color 137, respectively. Moreover, in one embodiment, the control logic 115 clamps the values of the result of this blend operation to a predetermined number of bits based on the clamping tables in the gamma/clamping tables 124.

In an embodiment, the control logic 115 performs gamma correction of the values of the result of this blend operation based on the gamma table in the gamma/clamping tables 124. In one embodiment, the video 134 that is input into the background merge logic 106 has a gamma value of approximately 0.45. The video 134 is converted into a linear space during the operations within the background merge logic 106. Therefore, the resulting image 140 is converted from a linear state back to an image having a gamma of approximately 0.45 based on the gamma table in the gamma/clamping tables 124.

While embodiments of the invention may operate in a number of different systems, one embodiment is now described. In particular, FIG. 5 illustrates a system that merges a background color with a rendered foreground image, according to one embodiment of the invention. In particular, FIG. 5 illustrates a system 500 that includes a processor 502, a system memory 504, a bridge logic 506, the rendering engine 102, the frame buffer 104, the background merge logic 106, the video source 108 and the display monitor 110. The processor 502 and the system memory 504 are coupled to the bridge logic 506. The rendering engine 102 is coupled to the bridge logic 506 through a graphics bus 520. The rendering engine 102 is coupled to the frame buffer 104. The background merge logic 106 is coupled to the bridge logic 522 and the frame buffer 104 through a system bus 522. The background merge logic 106 is coupled to the display monitor 110. The background merge logic 106 is coupled to the video source 108 through a video bus 524.

In one embodiment, the processor 502 executes instructions of a graphics application that generates graphics instructions that are stored into the system memory 504 through the bridge logic 506. The rendering engine 102 retrieves at least a part of these graphics instructions and renders foreground images (to be displayed on the display monitor 110) based on such instructions. The rendering engine 102 stores color values of these rendered foreground images into the frame buffer 104. The background merge logic 106 retrieves at least a part of these graphic instructions (stored in the system memory 504) for its configuration. For example, such graphics instructions may update the colors in the background color table 114. Additionally, the background merge logic 106 retrieves at least a part of these graphics instructions and merges video (from the video source 108) and/or background fill colors in the background color table 114 with the rendered foreground images (retrieved from the frame buffer 104) based on these instructions. In an embodiment, such instructions direct logic in the background merge logic 106 to use the other buffer (e.g., the A buffer 150 if the B buffer 152 is the current read buffer or vice versa) when the processing of data for a given scene being displayed has completed.

Thus, methods, apparatuses and systems for background rendering of images have been described. Although the present invention has been described with reference to specific exemplary embodiments, it will be evident that various modifications and changes may be made to these embodiments without departing from the broader spirit and scope of the invention. Therefore, the specification and drawings are to be regarded in an illustrative rather than a restrictive sense.

What is claimed is:

1. An apparatus comprising:

a rendering engine to render a foreground of an image to display, the image comprising a number of windows, each window identified by a window identification; and a logic, separate from the rendering engine, to blend at least one of first and second background colors with the foreground of the image, after the foreground of the image is rendered by the rendering engine, wherein the logic comprises a background color table that, for each window identification, includes the first background color in an A buffer background color column and the second background color in a B buffer background color column, the logic storing the first background color in the A buffer background color column when displaying the second background color in the B buffer background color column, and displaying the first background color in the A buffer background color column when storing the second background color in the B buffer background color column.

2. The apparatus of claim 1, further comprising a frame buffer to store pixels of the foreground, wherein the logic is to retrieve the color values of the foreground.

3. The apparatus of claim 2, wherein the frame buffer includes ping-pong type buffers to store color values of the foreground, the frame buffer further including a Z buffer to store the window identification-where the pixels of the foreground are located, wherein the apparatus further comprises a buffer select table to store an identification of one of the ping-pong type buffers that includes the color values of the foreground of the image.

4. The apparatus of claim 3, wherein the logic is to merge the at least one background color with the foreground of the image based on the identification of the window stored in the Z buffer and the identification of the one of the ping-pong type buffers stored in the buffer select table.

5. A system for generating a merged image to display comprising a number of windows, each window identified by a window identification, the system comprising:

a system memory;

a processor to generate graphics instructions based on execution of a graphics application, wherein the processor is to store the graphics instructions into the system memory;

a rendering engine coupled to the system memory through a graphics bus, the rendering engine to retrieve at least a part of the graphics instructions from the system memory and to render a foreground image based on the retrieved part of the graphics instructions; and a background merge logic, separate from the rendering engine, and coupled to the system memory through a system bus, wherein the background merge logic is to retrieve at least a part of the graphics instructions from the system memory, wherein the background merge logic includes a background color table, the background merge logic to store at least one of first and second background colors in the background color table based on the at least part of the graphics instructions, the first background color listed in an A buffer background color column for each window identification and the second background color listed in a B buffer background color column for each window identification, the background merge logic to blend, after the rendering engine has rendered the foreground image, the at least one background color received from the video source with a window of the rendered foreground image to generate the merged image, the background merge logic storing the first background color in the A buffer background color column when displaying the second background color in the B buffer background color column, and displaying the first background color in the A buffer background color column when storing the second background color in the B buffer background color column.

6. The system of claim 5, further comprising a frame buffer to store a current read buffer, a current write buffer, and a window buffer, and wherein the background merge logic includes a buffer select table, wherein the rendering engine is to store color values and an attenuation value of pixels of the foreground image into the current write buffer, the window identification for the pixels into the window buffer, and buffer identification for the pixels in the buffer select table.

7. The system of claim 6, wherein the background merge logic further comprises a multiply logic to multiply the at least one background color for the window of the rendered foreground image with the attenuation value of the pixels for the window to generate an adjusted background color.

8. The system of claim 7, wherein the background merge logic further comprises an add logic to add the color values of the pixels of the foreground image with the adjusted background color.

9. The system of claim 5, further comprising a display monitor, wherein the background merge logic is to output the merged image for display on the display monitor.

10. A method comprising:

retrieving a foreground of an image rendered by a rendering engine, the image comprising a number of windows, each window identified by a window identification;

blending at least one of first and second background colors from a background color table with the foreground of the image, independent of the rendering engine and after the foreground is rendered by the rendering engine, the first background color stored in an A buffer background color column of the background color table for each window identification and the second background color stored in a B buffer background color column of the background color table for each window identification;

displaying the image; and storing the first background color in the A buffer background color column when displaying the second background color in the B buffer background color column, and displaying the first background color in the A buffer background color column when storing the second background color in the B buffer background color column.

11. The method of claim 10, wherein blending the at least one background color into the image comprises: multiplying an alpha intensity value of the foreground with a value of the at least one background color; and adding a color value of the foreground with the value of the at least one background color.

12. The method of claim 10, wherein the alpha intensity value and the color value of the foreground of the image are stored in an A buffer or a B buffer in a frame buffer and wherein the background color table is not in the frame buffer.

13. The method of claim 12, further comprising selecting the at least one background color based on an identification of a window.

14. A method of rendering an image, the image comprising a number of windows, each window identified by a window identification, the method comprising:

performing the following operations in a hardware logic that is separate from a rendering engine that renders at least one foreground pixel for a window in the image, wherein the following operations are performed after the at least one foreground pixel is rendered:

retrieving the at least one foreground pixel from a frame buffer;

blending color data of a video with the at least one foreground pixel, upon determining that the video is in the background at a location of the foreground pixel;

blending a background pixel with the at least one foreground pixel, upon determining that the video is not in the background at the location of the foreground pixel, wherein only one of the color data of the video and the background pixel is blended with the at least one foreground pixel, and the blending the background pixel with the at least one foreground pixel comprises retrieving the background pixel from a background color table that is internal to the hardware logic based on an identification of the window, the background color table having, for each window identification, a first background color stored in an A buffer background color column and the second background color stored in a B buffer background color column;

displaying the image; and storing the first background color in the A buffer background color column when displaying the second background color in the B buffer background color column, and displaying the first background color in the A buffer background color column when storing the second background color in the B buffer background color column.

15. The method of claim 14, wherein blending the background pixel with the at least one foreground pixel comprises: multiplying an alpha intensity value of the at least one foreground pixel with a value of the background pixel; and adding a value of the foreground pixel with the value of the background pixel.

16. A method comprising:

rendering an image in a front-to-back order, wherein the rendering comprises: rendering, by a rendering engine, foreground pixels of the image, the image comprising a number of windows, each window identified by a window identification;

blending, by a hardware logic that is separate from the rendering engine, the image based on a merger of a background fill pixels with the foreground pixels, wherein, for each background fill pixel, a background color table includes a first background color in an A buffer background color column and the second background color in a B buffer background color column;

displaying the image; and storing the first background color in the A buffer background color column when displaying the second background color in the B buffer background color column, and displaying the first background color in the A buffer background color column when storing the second background color in the B buffer background color column.

17. The method of claim 16, wherein forming the image based on the merger of the background fill pixels with the foreground pixels comprises: assigning a weight of the background fill pixels relative to the foreground pixels based on alpha intensity values of the foreground pixels; and merging the background fill pixels with the foreground pixels based on the assigned weight of the background fill pixels.

18. A method for displaying an image, the method comprising:

rendering, by a rendering engine, color data of a foreground pixel for a window of the image, the color data including an alpha intensity value;

storing, by the rendering engine, the color data for the foreground pixel into a current write buffer of a ping/pong buffer;

performing the following operations, after rendering of the color data by the rendering engine, in a graphics logic having a background color table, independent of operations by the rendering engine:

retrieving an identification of the window;

retrieving, based on the identification of the window, an identification of a current read buffer of the ping/pong buffer from a buffer select table;

retrieving color data of a background pixel located at a same location in the image as the foreground pixel from the background color table based on the identification of the window and the identification of current read buffer, the background color table having a first background color in an A buffer background color column and a second background color in a B buffer background color column;

adjusting an intensity of the color data of the background pixel based on the alpha intensity value;

blending the adjusted color data of the background pixel with the color data of the foreground pixel; and displaying the merged background pixel data and foreground pixel data; and storing the first background color in the A buffer background color column when displaying the second background color in the B buffer background color column, and displaying the first background color in the A buffer background color column when storing the second background color in the B buffer background color column.

* * * * *